US011535470B2

(12) United States Patent
Suzuki et al.

(10) Patent No.: US 11,535,470 B2
(45) Date of Patent: Dec. 27, 2022

(54) TRANSPORT DEVICE, PRINTING APPARATUS, AND METHOD FOR ADJUSTING FEEDING UNIT

(71) Applicant: SEIKO EPSON CORPORATION, Tokyo (JP)

(72) Inventors: Manabu Suzuki, Matsumoto (JP); Tsutomu Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 386 days.

(21) Appl. No.: 16/752,038

(22) Filed: Jan. 24, 2020

(65) Prior Publication Data

US 2020/0239251 A1 Jul. 30, 2020

(30) Foreign Application Priority Data

Jan. 24, 2019 (JP) ..... JP2019-009970

(51) Int. Cl.

| | |
|---|---|
| ***B41J 15/04*** | (2006.01) |
| ***B65H 23/032*** | (2006.01) |
| ***B65H 5/02*** | (2006.01) |
| ***B41J 3/407*** | (2006.01) |

(52) U.S. Cl.

CPC ..... *B65H 5/021* (2013.01); *B41J 3/407* (2013.01); *B41J 15/048* (2013.01); *B65H 23/0326* (2013.01); *B65H 2402/31* (2013.01); *B65H 2402/32* (2013.01); *B65H 2511/21* (2013.01); *B65H 2801/03* (2013.01)

(58) Field of Classification Search

CPC ... B41J 15/046; B41J 15/048; B65H 2301/33; B65H 2301/331; B65H 2301/332; B65H 2301/33216; B65H 23/0326

See application file for complete search history.

(56) References Cited

U.S. PATENT DOCUMENTS

| | | | | |
|---|---|---|---|---|
| 4,407,439 | A | 10/1983 | Buss | |
| 2014/0045666 | A1* | 2/2014 | Endou | B65H 23/038 493/186 |

FOREIGN PATENT DOCUMENTS

| | | | |
|---|---|---|---|
| GB | 2259504 | | 3/1993 |
| JP | H11-011757 | | 1/1999 |
| JP | H1111757 | * | 1/1999 |

OTHER PUBLICATIONS

Hitoshi, MachineTranslationofJPJPH1111757, 1999 (Year: 1999).*

* cited by examiner

*Primary Examiner* — Scott A Richmond

(74) *Attorney, Agent, or Firm* — Workman Nydegger

(57) ABSTRACT

Provided is a transport device including a feeding unit on which a roll-type medium is set and which feeds the medium by rotating the medium, and an endless transport belt that transports the medium in a transport direction by supporting the medium fed out from the feeding unit and rotating. When seen from a support direction in which the transport belt supports the medium, the feeding unit is configured to change the posture thereof so as to incline a rotating shaft of the medium with respect to a width direction that is a direction intersecting the transport direction.

8 Claims, 13 Drawing Sheets

TRANSPORT DEVICE, PRINTING APPARATUS, AND METHOD FOR ADJUSTING FEEDING UNIT

The present application is based on, and claims priority from JP Application Serial Number 2019-009970, filed Jan. 24, 2019, the disclosure of which is hereby incorporated by reference herein in its entirety.

BACKGROUND

1. Technical Field

The present disclosure relates to a transport device, a printing apparatus, and a method for adjusting a feeding unit.

2. Related Art

In related art, various transport devices that transport a medium are used. Of these, a transport device is known that is provided with a feeding unit that feeds a medium by rotating the roll-type medium, and a transport belt that transports the medium fed out from the feeding unit in a transport direction. For example, in JP-A-11-11757 a sheet transport device is disclosed that is provided with a winding roller that feeds a fabric by rotating the roll-type fabric, and an endless belt that transports the fabric fed out from the winding roller in the transport direction.

In the sheet transporting device disclosed in JP-A-11-11757, a configuration is adopted in which the winding roller can be moved in the width direction of the fabric in order to suppress meandering of the fabric that is the sheet. On the other hand, a difference between a distance from an end portion on a first side in the width direction of the winding roller to the endless belt, and a distance from an end portion on a second side in the width direction of the winding roller to the endless belt can be given as one factor causing the meandering. For convenience, this type of difference is referred to "a left-right difference in feed distances." Then, in a configuration such as that of JP-A-11-11757, the left-right difference in the feed distances does not change even when the winding roller is moved in the width direction of the fabric. Therefore, an effect of suppressing the meandering of the fabric is small. In addition, when the left-right difference in the feed distances is large, various transport defects, such as the occurrence of wrinkles in the medium, may occur in addition to the meandering of the medium.

SUMMARY

A transport device according to the present disclosure for solving the above-described problems includes a feeding unit on which a roll-type medium is set, and that is configured to feed the medium by rotating the set medium, and an endless transport belt configured to feed the medium in a transport direction by supporting the medium fed out from the feeding unit and rotating. The feeding unit, when viewed from a support direction in which the transport belt supports the medium, is configured to change a posture thereof to incline a rotating shaft of the medium with respect to a width direction that is a direction intersecting the transport direction.

DESCRIPTION OF EXEMPLARY EMBODIMENTS

Figure 1:
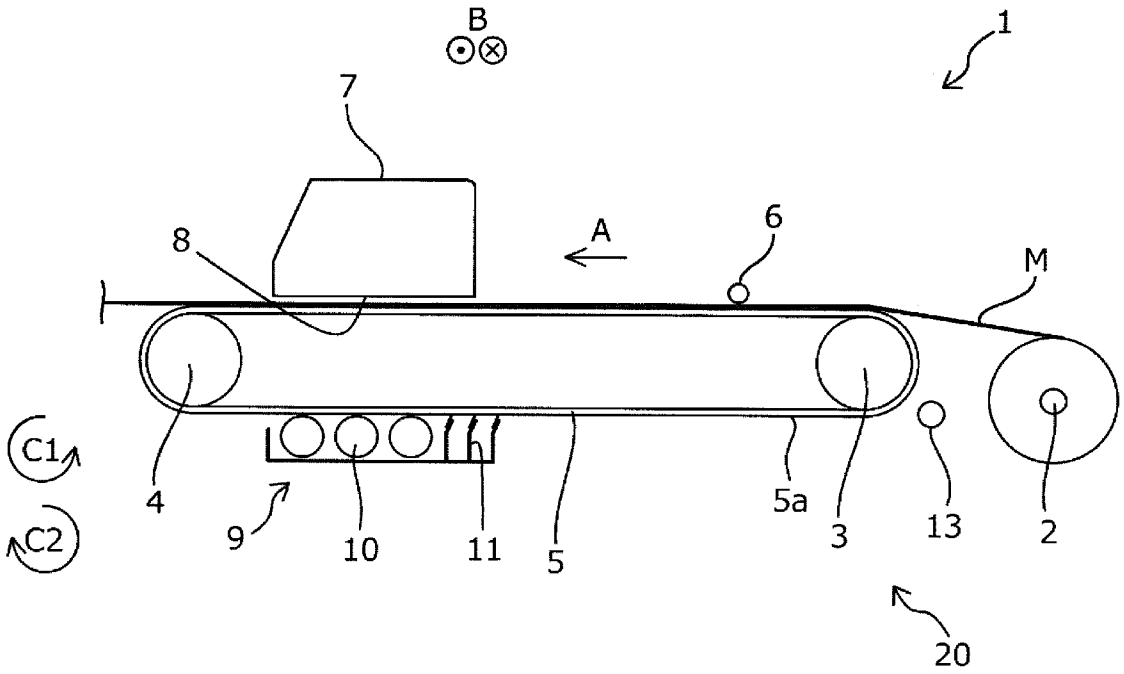
FIG. 1 is a schematic side view of a printing apparatus according to Example 1 of the present disclosure.

First, an outline description will be made of the present disclosure.

A transport device according to a first aspect of the present disclosure for solving the above-described problems includes a feeding unit on which a roll-type medium is set, and that is configured to feed the medium by rotating the set medium, and an endless transport belt configured to feed the medium in a transport direction by supporting the medium fed out from the feeding unit and rotating. The feeding unit, when viewed from a support direction in which the transport belt supports the medium, is configured to change a posture thereof to incline a rotating shaft of the medium with respect to a width direction that is a direction intersecting the transport direction.

According to this aspect, the feeding unit is capable of changing the posture thereof to incline the rotating shaft of the medium with respect to the width direction. Thus, a difference between a feed distance of the medium from an end portion on a first side in the width direction of the feeding unit to the transport belt, and a feed distance of the medium from an end portion on a second side in the width direction of the feeding unit to the transport belt can be adjusted. Transport defects of the medium can thus be suppressed. Note that, for convenience, "the difference between the feed distance of the medium from the end portion on the first side in the width direction of the feeding unit to the transport belt, and the feed distance of the medium from the end portion on the second side in the width direction of the feeding unit to the transport belt" is referred to as "a left-right difference in feed distances."

The transport device according to a second aspect of the present disclosure is the transport device according to the first aspect in which the feeding unit, when viewed from the support direction, is configured to rotate around a rotational fulcrum to incline the rotating shaft with respect to the width direction.

According to this aspect, the left-right difference in the feeding distances can be easily adjusted by rotating the feeding unit.

The transport device according to a third aspect of the present disclosure is the transport device according to the second aspect in which the feeding unit includes the rotational fulcrum in a central portion of the feeding unit in the width direction.

According to this aspect, by including the rotational fulcrum in the central portion of the feeding unit in the width direction, the left-right difference in the feed distances can be adjusted with a high degree of accuracy.

The transport device according to a fourth aspect of the present disclosure is the transport device according to the second or third aspects, further including a main body configured to hold the transport belt, and a coupling portion configured to couple the feeding unit and the main body. The feeding unit is configured to rotate with respect to the main body, with the coupling portion serving as a fulcrum.

According to this aspect, the feeding unit is configured to be rotatable with respect to the main body, with the coupling portion serving as the fulcrum, and thus, the left-right difference in the feed distances can be favorably adjusted.

The transport device according to a fifth aspect of the present disclosure is the transport device according to the fourth aspect, in which the coupling portion is configured to move, together with the feeding unit, in the width direction with respect to the main body.

According to this aspect, the coupling portion is configured to be movable, together with the feeding unit, in the width direction with respect to the main body, and thus, the medium can be supported at an appropriate position in the width direction of the transport belt.

The transport device according to a sixth aspect of the present disclosure is the transport device according to the fourth aspect, in which the feeding unit is configured to move in the width direction with respect to the coupling portion.

According to this aspect, the feeding portion is configured to be movable in the width direction with respect to the coupling portion, and thus, the medium can be supported at an appropriate position in the width direction of the transport belt.

The transport device according to a seventh aspect of the present disclosure is the transport device according to any one of the fourth to sixth aspects, in which the coupling portion is disposed in a region between the rotating shaft and a first contact position, the first contact position being a position at which the medium set on the feeding unit first comes into contact with a member of the main body.

According to this aspect, the coupling portion is disposed in the region between the rotating shaft of the medium and the position at which the medium set on the feeding unit first comes into contact with the member of the main body. As a result of such a configuration, it is possible to suppress a load acting on the coupling portion.

The transport device according to an eighth aspect of the present disclosure is the transport device according to any one of the first to seventh aspects, in which the feeding unit includes a fixing member configured to fix the posture of the feeding unit.

According to this aspect, the feeding unit includes the fixing member that fixes the posture of the feeding unit itself, and it is therefore possible to suppress an unintentional change in the posture of the feeding unit from the adjusted posture.

The transport device according to a ninth aspect of the present disclosure is the transport device according to any one of the first to eighth aspects, further including a printing unit configured to perform printing on the medium supported by the transport belt.

According to this aspect, printing can be performed while suppressing transport defects of the medium.

A method for adjusting a feeding unit according to a tenth aspect of the present disclosure is a method for adjusting a feeding unit in a transport device including a feeding unit on which a roll-type medium is set, and that is configured to feed the medium by rotating the set medium, and an endless transport belt configured to feed the medium in a transport direction by supporting the medium fed out from the feeding unit and rotating. The method for adjusting the feeding unit includes adjusting a difference between a feed distance of the medium from an end portion on a first side in a width direction of the feeding unit to the transport belt, and a feed distance of the medium from an end portion on a second side in the width direction of the feeding unit to the transport belt, by changing a posture of the feeding unit, when viewed from a support direction in which the transport belt supports the medium, to incline a rotating shaft of the medium with respect to the width direction that is a direction intersecting the transport direction.

According to this aspect, it is possible to adjust the difference between the feed distance of the medium from the end portion on the first side in the width direction of the feeding unit to the transport belt, and the feed distance of the medium from the end portion on the second side in the width direction of the feeding unit to the transport belt, that is, to adjust the left-right difference in the feed distances. Thus, transport defects of the medium can be suppressed.

Embodiments of the present disclosure will be described below with reference to the accompanying drawings.

Example 1 (FIG. 1 to FIG. 11)

First, an outline of a printing apparatus 1 according to Example 1 of the present disclosure will be described with reference to FIG. 1.

As illustrated in FIG. 1, the printing apparatus 1 of this example is provided with a transport device 20 capable of transporting a medium M in a transport direction A. The transport device 20 is provided with a feeding unit 2 capable of feeding the medium M as a result of the roll-type medium M being set on the feeding unit 2 and rotating in a rotational direction C1. Further, the transport device 20 is also provided with a transport belt 5 capable of transporting the medium M, which has been fed out from the feeding unit 2, in the transport direction A. A detailed configuration of the transport device 20, which is a main part of the printing apparatus 1 of this example, will be described later. The transport device 20 is provided with a driven roller 3 located upstream in the transport direction A, a driving roller 4 located downstream in the transport direction A, and the transport belt 5, which is an endless belt stretched across the driven roller 3 and the driving roller 4.

Here, the transport belt 5 is an adhesive belt coated with an adhesive on a support surface 5*a*, which is a surface on the outer side of the transport belt 5. As illustrated in FIG. 1, the medium M is supported and transported by the transport belt 5 in a state in which the medium M is adhered to the support surface 5*a* coated with the adhesive. In other words, the transport belt 5 is a support portion for the medium M. A support region over which the transport belt 5 supports the medium M is an upper-side region of the transport belt 5 that is stretched across the driven roller 3 and the driving roller 4. Further, the driving roller 4 is a roller that is rotated by a driving force of a motor (not illustrated), and the driven roller 3 is a roller that rotates by being driven by the rotation of the transport belt 5 in accordance with the driving roller 4 being rotated.

Further, the printing apparatus 1 includes a carriage 7 capable of reciprocating in a width direction B of the transport belt 5, and a head 8 attached to the carriage 7. The head 8 functions as a printing unit capable of printing an image on the medium M transported in the transport direction A. The head 8 is provided in a position facing the support region of the medium M on the transport belt 5, and is capable of ejecting ink. At this time, the support region of the medium M on the transport belt 5 can be said to be an opposing region facing the head 8. The printing apparatus 1 of this example is capable of printing the image by ejecting ink from the head 8 onto the transported medium M while causing the carriage 7 to reciprocate in the width direction B intersecting the transport direction A. As a result of being provided with the carriage 7 configured in this manner, the printing apparatus 1 of this example can form a desired image on the medium M by repeating the transport of the medium M in the transport direction A by a predetermined transport amount, and the ejection of the ink while moving the carriage 7 in the width direction B in a state in which the medium M is stopped.

Note that the printing apparatus 1 of this example is a so-called serial printer that performs the printing by alternately repeating the transport of the medium M by the predetermined transport amount and the reciprocating movement of the carriage 7. However, the printing apparatus 1 may be a so-called line printer, which uses a line head in which nozzles are formed in a line shape in the width direction B of the medium M, and which continuously performs printing while continuously transporting the medium M. Furthermore, the printing apparatus 1 may be a printing apparatus provided with a printing unit having a configuration different from a so-called inkjet printing unit that ejects ink and performs the printing.

In addition, a medium affixing portion 6 is formed in a position facing the transport belt 5, upstream of the carriage 7 in the transport direction A. The medium affixing portion 6 affixes the medium M to the transport belt 5, in a state in which the generation of wrinkles and the like is suppressed, by pressing the medium M against the transport belt 5 across the width direction B of the medium M.

After being discharged from the printing apparatus 1 of this example, the medium M on which the image is formed is fed to a drying device that volatilizes components of the ink ejected onto the medium M, a winding device that takes up the medium M on which the image is formed, and the like, which are provided at later stages than the printing apparatus 1 of this example.

Here, a material for textile printing can be preferably used as the medium M. The term "material for textile printing" refers to a fabric, a garment, other clothing products and the like that are subject to textile printing. Fabrics include woven cloths, knit fabrics, non-woven cloths, and the like made of natural fibers such as cotton, silk, wool, and the like, chemical fibers such as nylon and the like, or composite fibers of natural fibers and chemical fibers. Further, the garments and other clothing products include sewn products, such as T-shirts, handkerchiefs, scarfs, towels, handbags, and fabric bags, furniture-related products such as curtains, sheets, and bed covers, as well as fabrics and the like before and after cutting that serve as pieces of cloth before sewing.

Furthermore, in addition to the material for textile printing described above, dedicated inkjet printing paper, such as plain paper, high quality paper, glossy paper, and the like, can be used as the medium M. Further, for example, a plastic film whose surface has not been processed for inkjet printing, that is, on which an inkjet absorption layer is not formed, as well as a material in which plastic is coated on a substrate of paper or the like, and a material to which a plastic film has been adhered can also be used as the medium M. Such plastic materials include, but are not limited to, for example, polyvinyl chloride, polyethylene terephthalate, polycarbonate, polystyrene, polyurethane, polyethylene, and polypropylene.

When the material for textile printing is used as the medium M, the material for textile printing is susceptible to strike-through of the ink, in which the ink ejected onto the medium M seeps through to a surface on the reverse side of the medium M, and there are cases in which the transport belt 5 is stained by the ink. Here, the printing apparatus 1 of this example is provided with a cleaning unit 9 that cleans up the ink that has adhered to the transporting belt 5 as a result of the strike-through. The cleaning unit 9 of this example is provided with three cleaning brushes 10 that are impregnated with a cleaning liquid and make contact with the transport belt 5, and a blade unit 11 including three blades, which wipe off cleaning liquid that has adhered to the transport belt 5 as a result of the cleaning brushes 10 coming into contact with the transport belt 5. Furthermore, the printing apparatus 1 of this example is provided with an air blowing unit 13 capable of drying the cleaning liquid that has not been completely wiped off by the blade unit 11.

The printing apparatus 1 of this example is capable of transporting the medium M in the transport direction A by rotating the driving roller 4 in the rotational direction C1. Further, the printing apparatus 1 of this example is also capable of transporting the medium M in the direction opposite from the transport direction A, by rotating the driving roller 4 in a rotational direction C2, which is the opposite direction from the rotational direction C1.

Next, a detailed configuration of the transport device 20, which is a main portion of the printing apparatus 1 of this example, will be described in detail with reference to FIG. 2 to FIG. 11.

Figure 3:
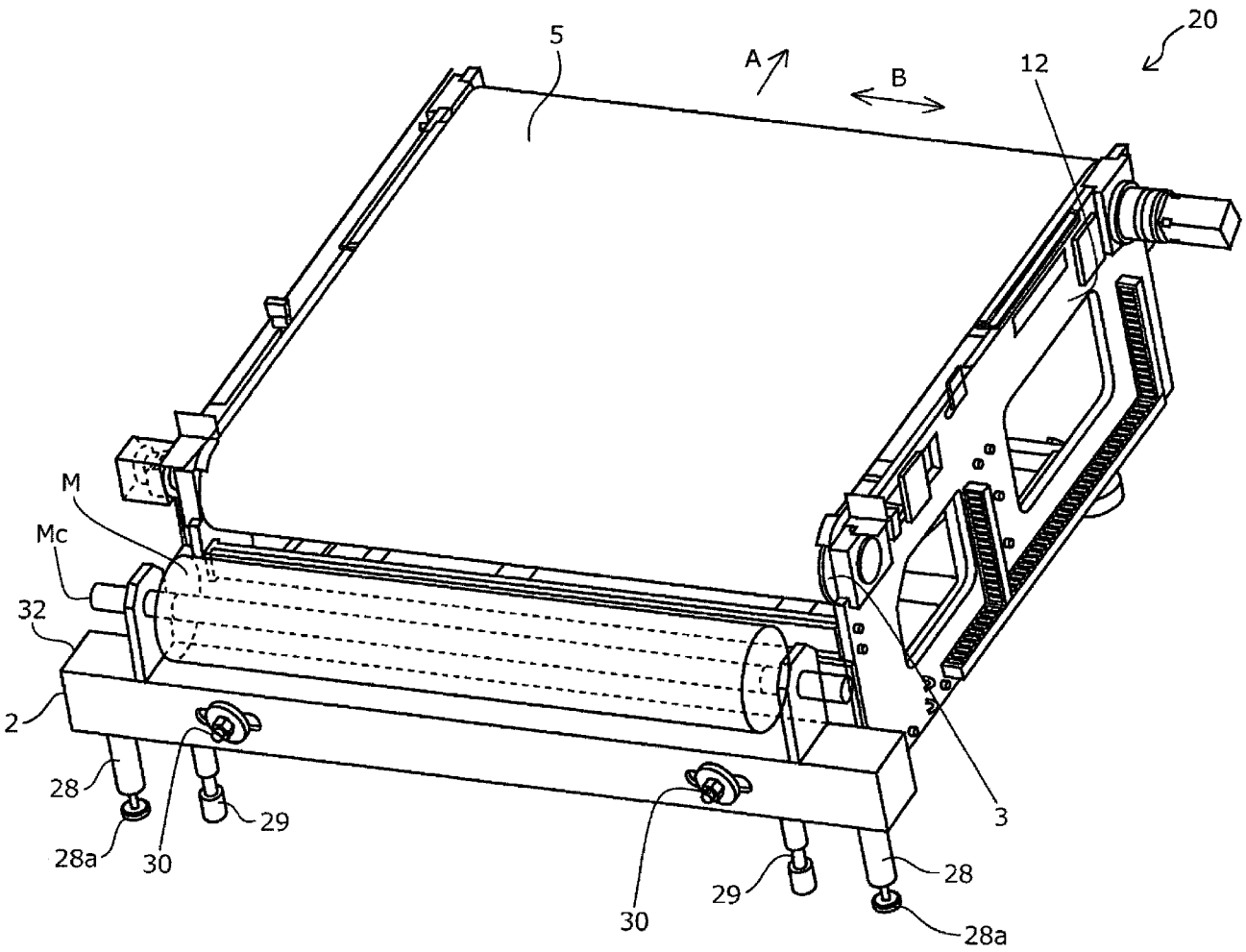
FIG. 3 is a perspective view of the transport device in the printing apparatus according to Example 1 of the present disclosure when viewed from above.
Figure 4:
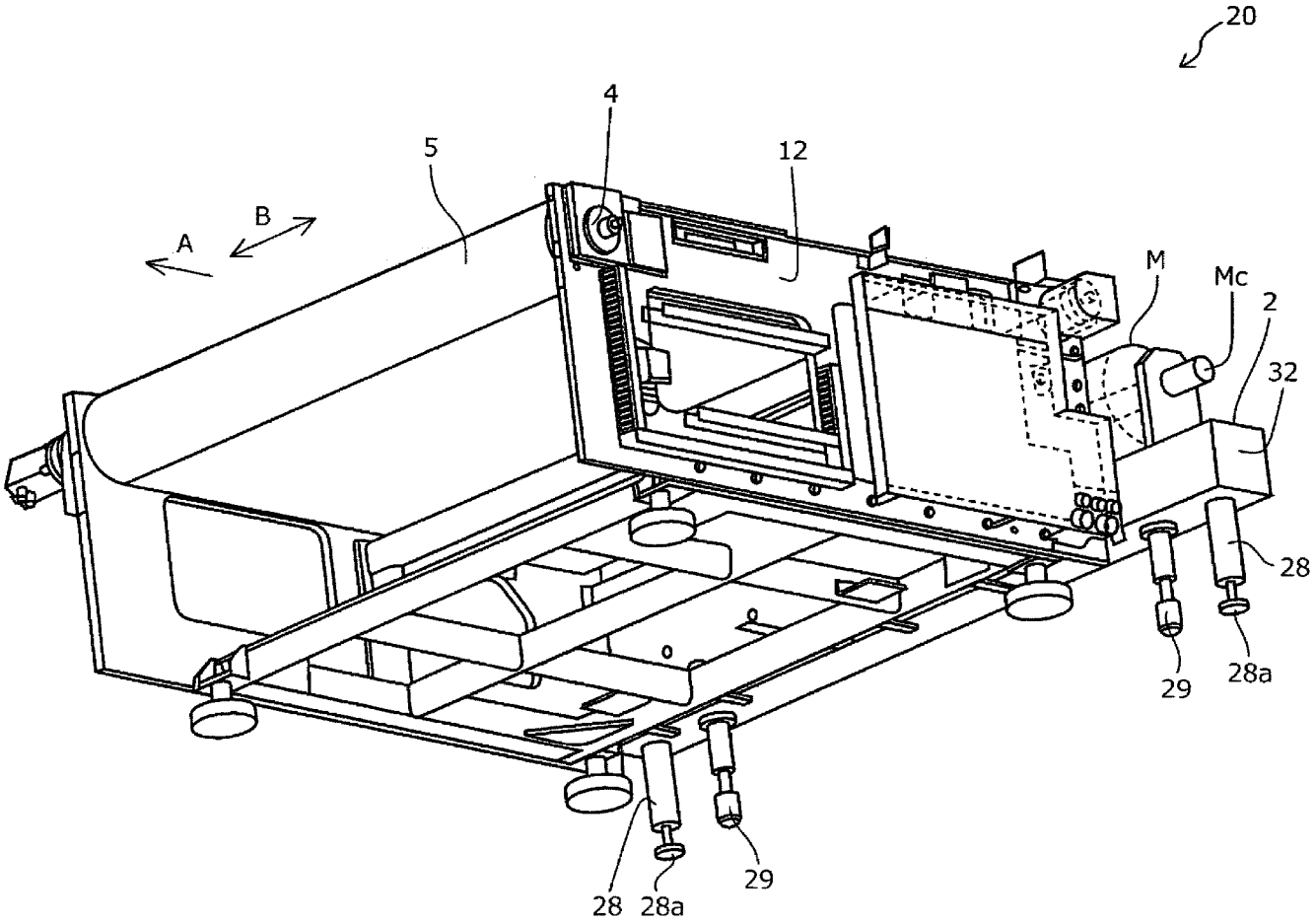
FIG. 4 is a perspective view of the transport device in the printing apparatus according to Example 1 of the present disclosure when viewed from below.

As illustrated in FIG. 3, FIG. 4, and the like, the transport device 20 of this example is provided with the feeding unit 2, on which the roll-type medium M is set, and which feeds the medium M by rotating the set medium M. The feeding unit 2 includes a rotating shaft Mc. When setting the medium M on the feeding unit 2, specifically, the medium M is set on the rotation shaft Mc. Then, the feeding unit 2 rotates the medium M by rotating the rotating shaft Mc. In this manner, a configuration is obtained in which the medium M is fed out from the feeding unit 2. Note that, other than the configuration in which the feeding unit 2 includes the rotating shaft Mc, the medium M and the rotating shaft Mc may be integrated with each other, and may be attached to and detached from the feeding unit 2.

In addition, the transport device 20 of this example is provided with a main body 12 that holds the transport belt 5. The main body 12 is configured by members such as a frame, side walls, and the like, and holds the transport belt 5 using these members.

Furthermore, as illustrated in FIG. 2, and FIG. 5 to FIG. 8, the transport device 20 of this example is provided with a coupling portion 14 that couples the feeding unit 2 and the main body 12. Note that in FIG. 2, the coupling portion 14 is illustrated in a simplified manner.

Here, the configuration of the coupling portion 14, and a movement mechanism of the feeding unit 2 with respect to the main body 12 will be described with reference to FIG. 5 to FIG. 11. As illustrated in FIG. 11 and the like, the coupling portion 14 includes a base 21 and a sliding stage 22. Furthermore, the coupling portion 14 includes a slide rail 24 fixed to the base 21, and a sliding portion 25 that is fixed to the sliding stage 22 and is slidable in the width direction B with respect to the slide rail 24. A long hole 22*a*, whose longitudinal direction is the width direction B, is formed in the sliding stage 22. A bolt 23*a* having a first end fixed to the base 21 is inserted through the long hole 22*a*. Then, a configuration is obtained in which, by loosening or tightening a nut 23*b* attached to a second end of the bolt 23*a*, the sliding stage 22 can be moved in the width direction B with respect to the base 21, and the sliding stage 22 can be fixed with respect to the base 21. Here, the sliding portion 25, the slide rail 24, and the feeding unit 2 are configured to move in an interlocking manner. In other words, by moving the sliding portion 25 in the width direction B with respect to the slide rail 24, the feeding unit 2 is configured to be movable in the width direction B with respect to the main body 12 to which the base 21 is attached. At this time, a range of movement of the feeding unit 2 is a range corresponding to an allowable range in the width direction B of the long hole 22*a* with respect to the bolt 23*a*.

Figure 5:
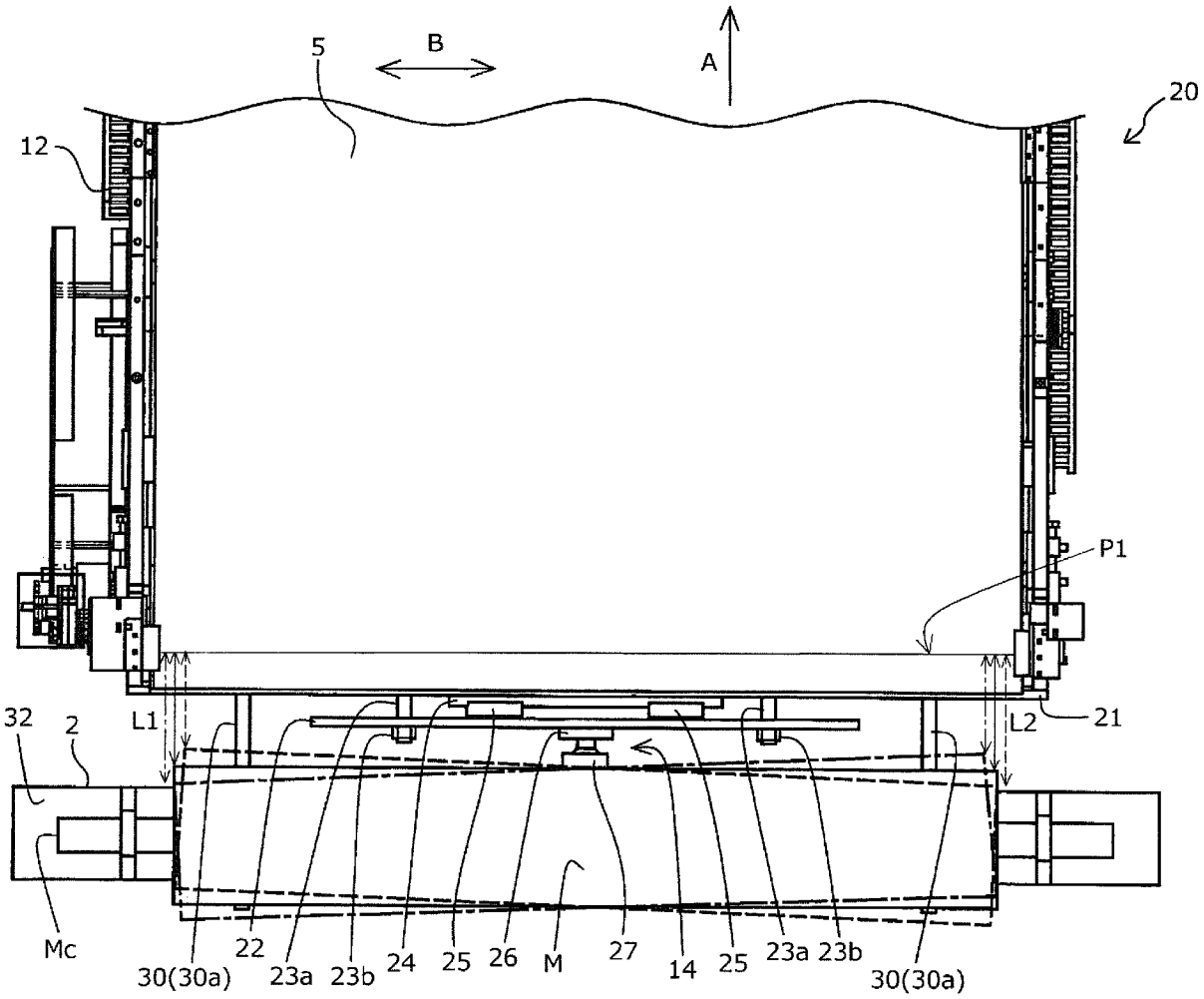
FIG. 5 is a plan view of part of the transport device in the printing apparatus according to Example 1 of the present disclosure.

Further, the coupling portion 14 includes a ball joint 26 fixed to the sliding stage 22, and a ball joint support portion 27 that is fixed to a rotating stage 32 of the feeding unit 2 and rotatably supports the ball joint 26. In this manner, the feeding unit 2 is coupled to the main body 12 by the ball joint 26, and thus the feeding unit 2 can be caused to rotate using the ball joint 26 and the ball joint support portion 27 as a rotational fulcrum. In other words, the feeding unit 2 is configured such that the posture of the feeding unit 2 can be changed with respect to the main body 12. At this time, when viewed from both the vertical direction and the horizontal direction, the feeding unit 2 is configured such that an arrangement of the feeding unit 2 with respect to the main body 12 can be shifted in a rotational direction, with the ball joint 26 and the ball joint support portion 27 serving as the rotational fulcrum. Further, as illustrated in FIG. 5, when paying attention to the movement when viewed from the vertical direction, the feeding unit 2, as viewed from the vertical direction, is configured to be rotatable around the ball joint 26 and the ball joint support portion 27, which serve as the rotational fulcrum, so as to incline the rotating shaft Mc with respect to the width direction B.

When the feeding unit 2 is rotated and moved in the rotational direction, the medium M set on the feeding unit 2 moves along with the feeding unit 2. In other words, it can also be said that shifting the arrangement of the feeding unit 2 shifts the arrangement of the medium M set on the feeding unit 2. In other words, a configuration is adopted in which the posture of the medium M set on the feeding unit 2 can be changed by changing the posture of the feeding unit 2 itself.

Figure 9:
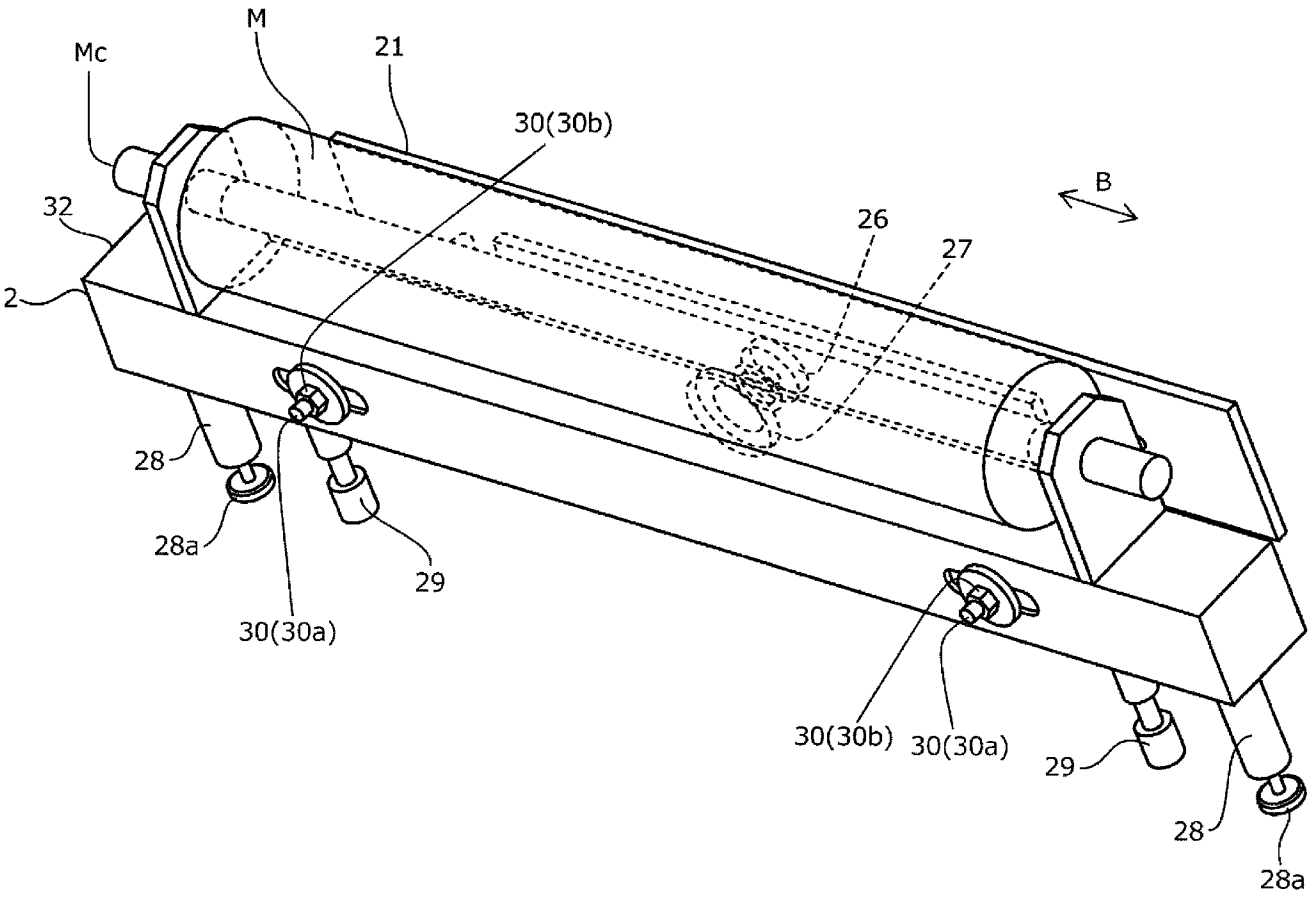
FIG. 9 is a perspective view of a feeding unit in the printing apparatus according to Example 1 of the present disclosure.
Figure 10:
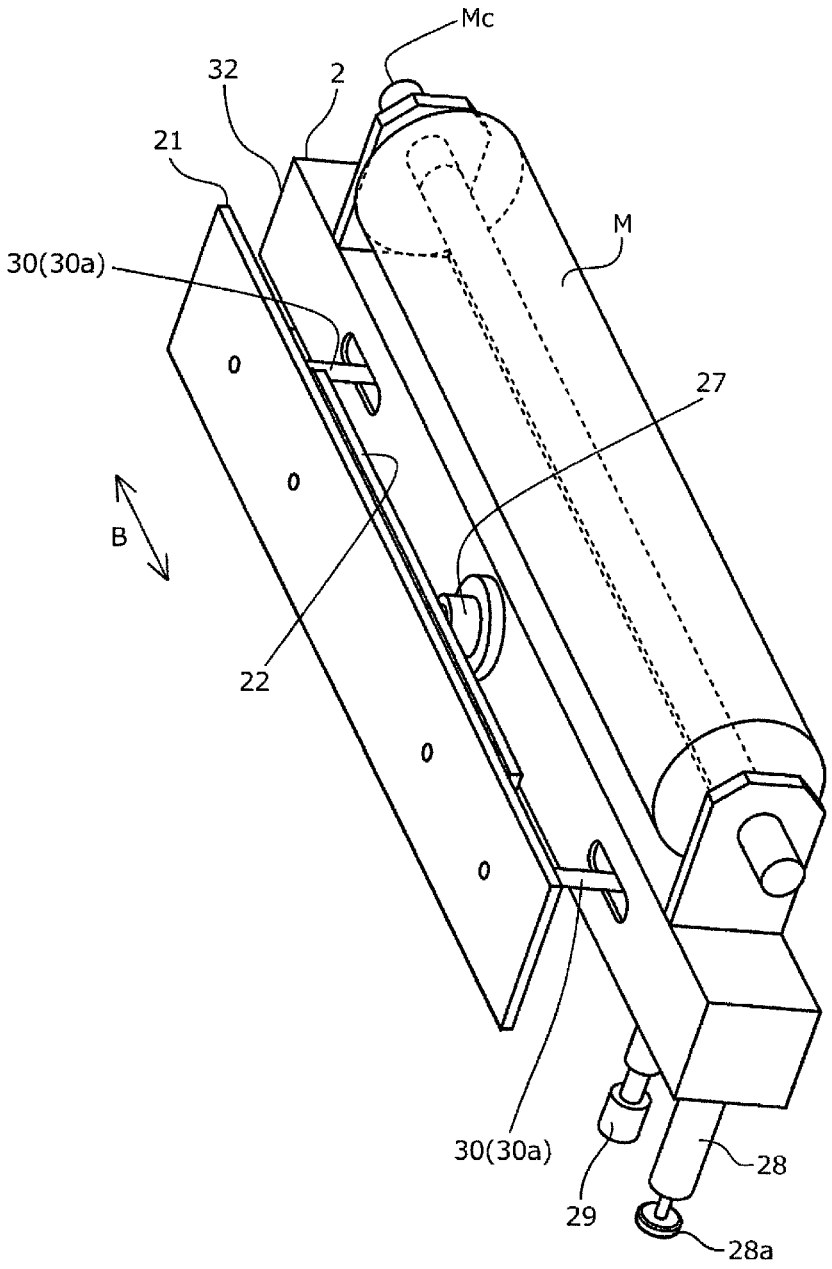
FIG. 10 is a perspective view of the feeding unit and a feeding unit movement mechanism in the printing apparatus according to Example 1 of the present disclosure.
Figure 11:
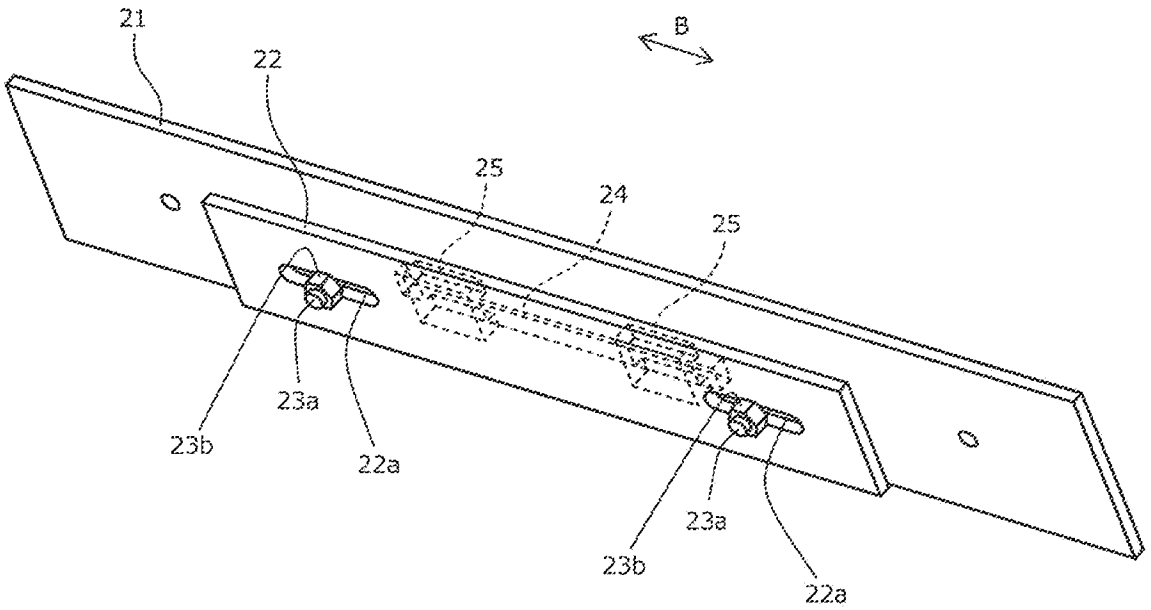
FIG. 11 is a perspective view of the feeding unit movement mechanism in the printing apparatus according to Example 1 of the present disclosure.

Note that, as illustrated in FIG. 9, FIG. 10, and the like, the feeding unit 2 of this example is provided with two legs 28 provided with height adjusting screws 28*a*. The legs 28 are configured to be able to adjust the position of the feeding unit 2 with respect to an installation surface by rotating the height adjusting screws 28*a*. Thus, the transport device 20 of this example is able to not only shift the arrangement of the feeding unit 2 with respect to the body unit 12 as viewed from the vertical direction, but is also able to shift the arrangement of the feeding unit 2 with respect to the main body 12 as viewed from the transport direction A, by respectively adjusting positions of the feeding unit 2 with respect to the installation surface using each of the height adjusting screws 28*a*.

Further, in addition to the two legs 28, the feeding unit 2 of this example is provided with two auxiliary legs 29 that facilitate the height adjustment using the height adjusting screws 28*a*. Each of the auxiliary legs 29 is provided with a damper and a ball plunger, and the height adjustment using the height adjusting screws 28*a* can be facilitated as a result of the auxiliary legs 29 being able to assist in supporting the feeding unit 2 when a user performs the height adjustment using the height adjusting screws 28*a*.

Note that, as described above, the arrangement of the feeding unit 2 with respect to the main body 12 as viewed from the transport direction A can be positioned and fixed using the two height adjusting screws 28*a*. On the other hand, the arrangement of the feeding unit 2 with respect to the main body 12 as viewed from the vertical direction can be positioned and fixed using two horizontal positioning screws 30. Each of the horizontal positioning screws 30 is configured by a bolt 30*a* having a first end thereof fixed to the base 21, and a nut 30*b* that is attached to a second end side of the bolt 30*a* on the other side of the feeding unit 2 from the first end.

Arrangements of the roll of the medium M, which are indicated using solid lines, dashed lines, and alternate long and short dash lines in FIG. 5, illustrate arrangement examples of the roll of the medium M when the arrangement of the feeding unit 2 is shifted with respect to the main body 12 as viewed from the vertical direction.

To summarize here, the transport device 20 of this example is provided with the feeding unit 2 on which the roll-type medium M is set and which feeds the set medium M by rotating the medium M, and with the endless transport belt 5 that transports the medium M in the transport direction A by supporting the medium M fed out from the feeding unit 2 and rotating. Then, when viewed from the vertical direction, the feeding unit 2 is configured such that the arrangement of the feeding unit 2 with respect to the main body 12 can be shifted in the rotational direction, using the ball joint 26 and the ball joint support portion 27 as the rotational fulcrum. Here, the vertical direction corresponds to a support direction in which the transport belt 5 supports the medium M. To express the configuration of the feeding unit 2 in another way, when viewed from the support direction in which the transport belt 5 supports the medium M, the feeding unit 2 is configured such that the posture of the feeding unit 2 can be changed so as to incline the rotating shaft Mc of the medium M with respect to the width direction B that is the direction intersecting the transport direction A.

In the transport device 20 of this example, as illustrated by the solid lines, the dashed lines, and the alternate long and short dash lines in FIG. 5, the posture of the feeding unit 2 can be changed so as to incline the rotating shaft Mc of the medium M with respect to the width direction B. As a result, it is possible to adjust a difference between a feed distance L1 of the medium M from an end portion on a first side in the width direction B of the feeding unit 2 to the transport belt 5, and a feed distance L2 of the medium M from an end portion on a second side in the width direction B of the feeding unit 2 to the transport belt 5, that is, adjust the left-right difference in the feed distances. Transport defects of the medium M can thus be suppressed.

In other words, the printing apparatus 1 of this example provided with the above-described transport device 20 and the head 8, which serves as a printing unit that performs the printing on the medium M supported on the transport belt 5, can perform the printing while suppressing transport defects of the medium M.

Further, the following method for adjusting a feeding unit can be executed using the transport device that is provided with the feeding unit 2, on which the roll-type medium M is set and which feeds the set medium M by rotating the medium M, and with the endless transport belt 5 that transports the medium M by supporting the medium M fed out from the feeding unit 2, and rotating, as in the transport device 20 of this example. When viewed from the support direction in which the transport belt 5 supports the medium M, by changing the posture of the feeding unit 2 so as to incline the rotating shaft Mc of the medium M with respect to the width direction B that is the direction intersecting the transport direction A, the difference can be adjusted between the feed distance L1 from the end portion on the first side in the width direction B of the feeding unit 2 to the transport belt 5, and the feed distance L2 from the end portion on the second side in the width direction B of the feeding unit 2 to the transport belt 5.

The method for adjusting the feeding unit adjusts the difference between the feed distance L1 from the end portion on the first side in the width direction B of the feeding unit 2 to the transport belt 5, and the feed distance L2 from the end portion on the second side in the width direction B of the feeding unit 2 to the transport belt 5, that is, adjusts the left-right difference in the feed distances. Thus, by executing the method for adjusting the feeding unit, transport defects of the medium M can be suppressed. Note that, as the method for adjusting the difference between the feed distance L1 and the feed difference L2, for example, a method for reducing the distance between the feed distance L1 at the end portion on the first side and the feed distance L2 at the end portion on the second side can be conceived. In addition, a method can be conceived in which, when a different tension is applied to the end portion on the first side and the end portion on the second side with respect to the medium M, and the medium M is already being transported in a slanted manner, the slanting of the medium M is reduced by adjusting the feed distances L1 and L2 such that the tension is intentionally applied to the opposite side, of the end portion on the first side and the end portion on the second side, with respect to the medium M.

Further, as described above, in the transport device 20 of this example, when viewed from the support direction, the feeding unit 2 is configured to be rotatable around the ball joint 26 and the ball joint support portion 27, which serve as the rotational fulcrum, so as to incline the rotating shaft Mc with respect to the width direction B. As with the transport device 20 of this example, by rotating the feeding unit 2, it is possible to easily adjust the difference between the feed distance L1 of the medium M from the end portion on the first side in the width direction B of the feeding unit 2 to the transport belt 5, and the feed distance L2 of the medium M from the end portion on the second side in the width direction B of the feeding unit 2 to the transport belt 5.

Figure 6:
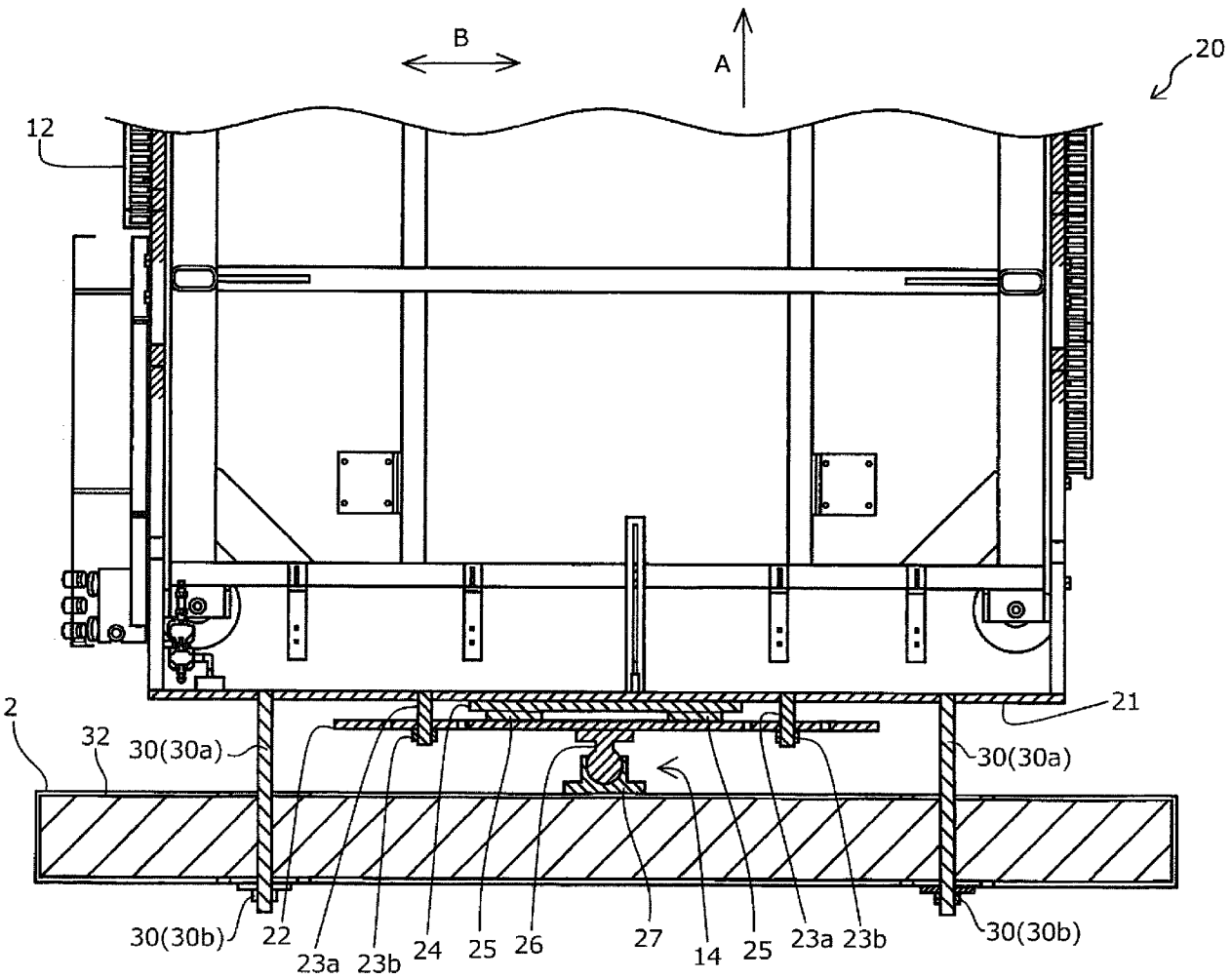
FIG. 6 is a plan cross-sectional view of part of the transport device in the printing apparatus according to Example 1 of the present disclosure.

Further, as illustrated in FIG. 5 and FIG. 6, in the transport device 20 of this example, the rotational fulcrum configured by the ball joint 26 and the ball joint support portion 27 is provided in a central portion, in the width direction B, of the feeding unit 2. In this way, by having the rotational fulcrum in the central portion of the feeding unit 2 in the width direction B, the difference between the feed distance L1 of the medium M from the end portion on the first side in the width direction B of the feeding unit 2 to the transport belt 5, and the feed distance L2 of the medium M from the end portion on the second side in the width direction B of the feeding unit 2 to the transport belt 5 can be adjusted with a high degree of accuracy. Note that the "central portion" here is not limited to a central position in a strict sense, but also includes a position near the center.

Here, as described above, the transport device 20 of this example is provided with the main body 12 that holds the transport belt 5, and the coupling portion 14 that couples the feeding unit 2 and the main body 12, and includes the rotational fulcrum configured by the ball joint 26 and the ball joint support portion 27 in the coupling portion 14. In other words, the feeding unit 2 of this example is configured to be rotatable with respect to the main body 12, with the coupling portion 14 serving as the fulcrum. By configuring the feeding unit 2 to be rotatable with respect to the main unit 12, with the coupling portion 14 serving as the fulcrum, it is possible to favorably adjust the difference between the feed distance L1 of the medium M from the end portion on the first side in the width direction B of the feeding unit 2 to the transport belt 5, and the feed distance L2 of the medium M from the end portion on the second side in the width direction B of the feeding unit 2 to the transport belt 5.

Further, as described above, the ball joint 26 and the ball joint support portion 27 that configure the coupling portion 14 in the transport device 20 of this example are configured such that the sliding stage 22 is movable in the width direction B with respect to the base 21. In other words, the coupling portion 14 of this example is configured to be movable, together with the feeding unit 2, in the width direction B with respect to the main body 12. As a result of such a configuration, the transport device 20 of this example can support the medium M at an appropriate position of the transport belt 5 in the width direction B. For example, when the medium M having a narrow width is used, the center position of the medium M in the width direction B can be easily aligned with the center position of the transport belt 5 in the width direction B. By aligning the center position of the medium M in the width direction B and the center position of the transport belt 5 in the width direction B, transport defects of the medium M can be effectively suppressed.

Figure 2:
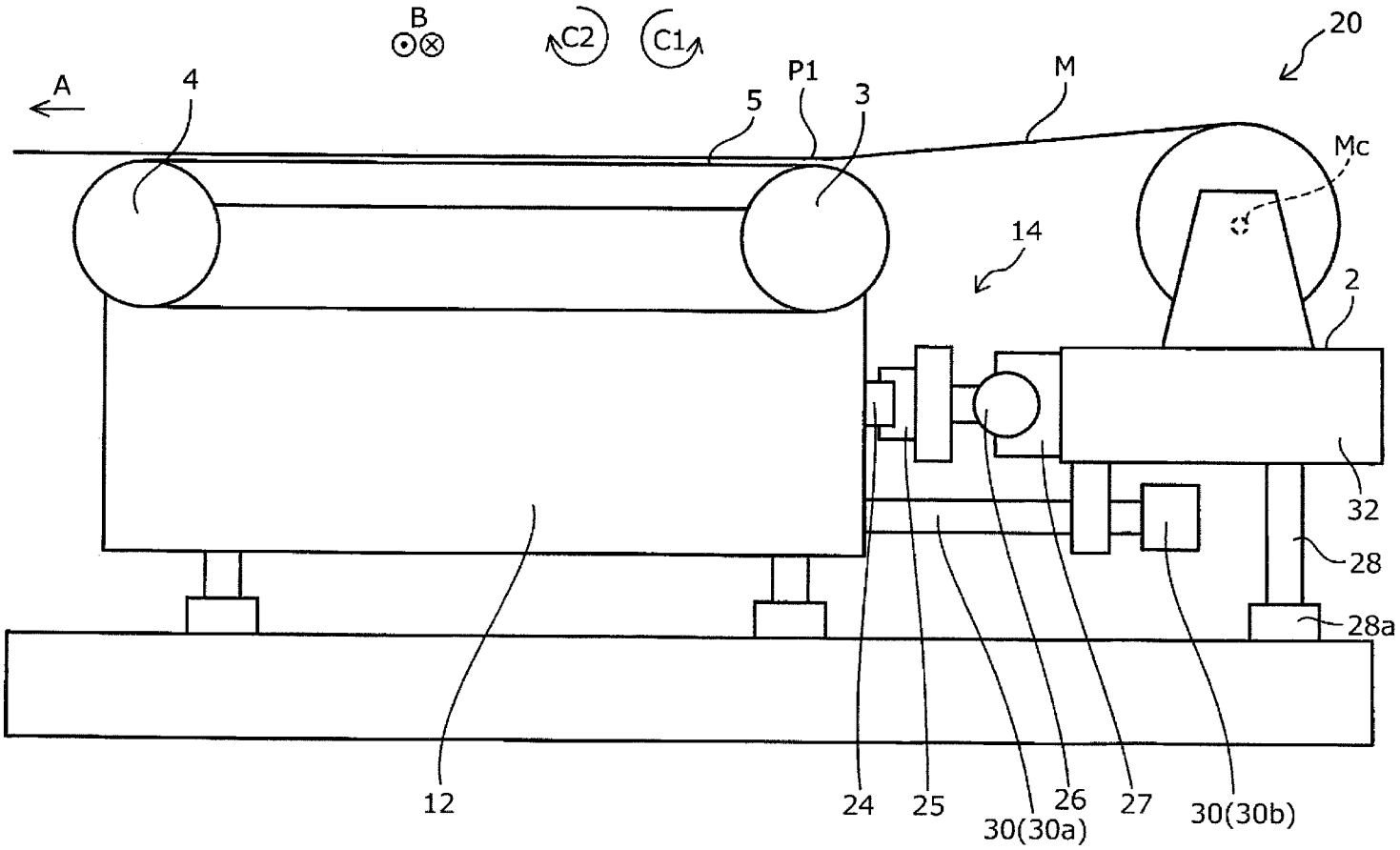
FIG. 2 is a schematic side view of a transport device in the printing apparatus according to Example 1 of the present disclosure.
Figure 7:
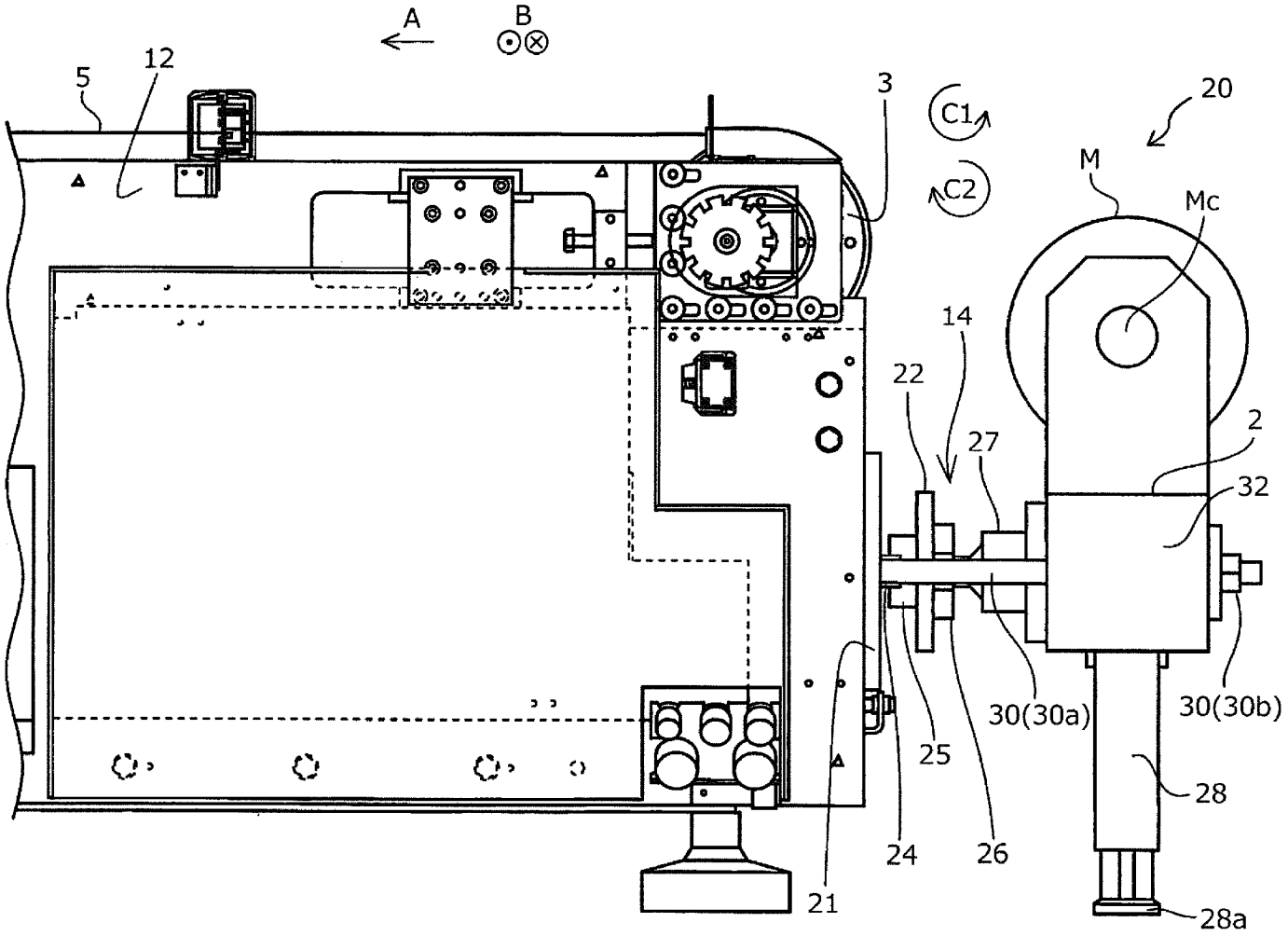
FIG. 7 is a side view of part of the transport device in the printing apparatus according to Example 1 of the present disclosure.
Figure 8:
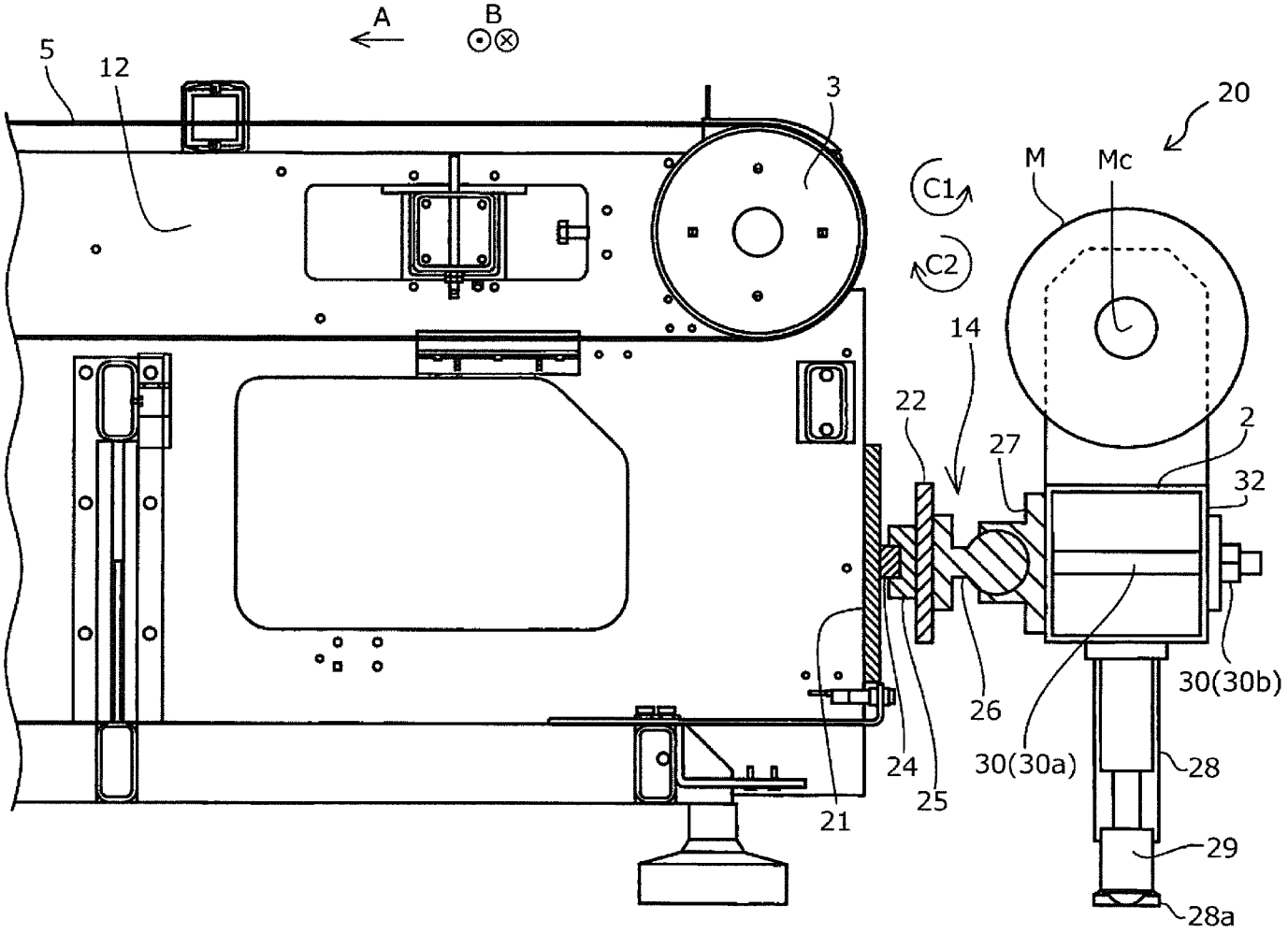
FIG. 8 is a side cross-sectional view of part of the transport device in the printing apparatus according to Example 1 of the present disclosure.

Further, as illustrated in FIG. 2, FIG. 7, FIG. 8, and the like, in the transport device 20 of this example, the coupling portion 14 is disposed in a position between the feeding unit 2 and the main body 12. Here, as illustrated in FIG. 2, in the transport device 20 of this example, a position at which the medium M set on the feeding unit 2 first comes into contact with a member of the main body 12 is referred to as a first contact position P1. At this time, the coupling portion 14 is disposed in a region between the rotating shaft Mc of the medium M and the first contact position P1. As a result of such a configuration, the transport device 20 of this example suppresses a load acting on the coupling portion 14. Note that the load acting on the coupling portion 14 can be further suppressed by shortening a distance between the coupling portion 14 and the medium M fed out from the feeding unit 2 to the main body 12. Note also that the first contact position P1 in this example 20 is a position at which the medium M fed out from the feeding unit 2 first comes into contact with the transport belt 5. However, when the medium M fed out from the feeding unit 2 comes into contact with another member of the main body 12 before reaching the transport belt 5, the position at which the medium M comes into contact with the other member is the first contact position P1. Examples of another member include a pressing roller that presses the medium M, a guide roller configuring a transport path of the medium M, and the like. In this case also, the coupling portion 14 is preferably disposed in the region between the rotating shaft Mc and the first contact position P1.

Further, as described above, the transport device 20 of this example includes the height adjusting screws 28*a* and the horizontal positioning screws 30 that position and then fix the feeding unit 2 with respect to the main body 12. At this time, the height adjusting screws 28*a* and the horizontal positioning screws 30 can be said to be fixing members that fix the posture of the feeding unit 2. In other words, the feeding unit 2 includes the fixing members that fix the posture of the feeding unit 2. In this way, the feeding unit 2 includes the fixing members that fix the posture of the feeding unit 2 itself, and it is therefore possible to suppress an unintentional change in the posture of the feeding unit 2 from the adjusted posture.

Figure 12:
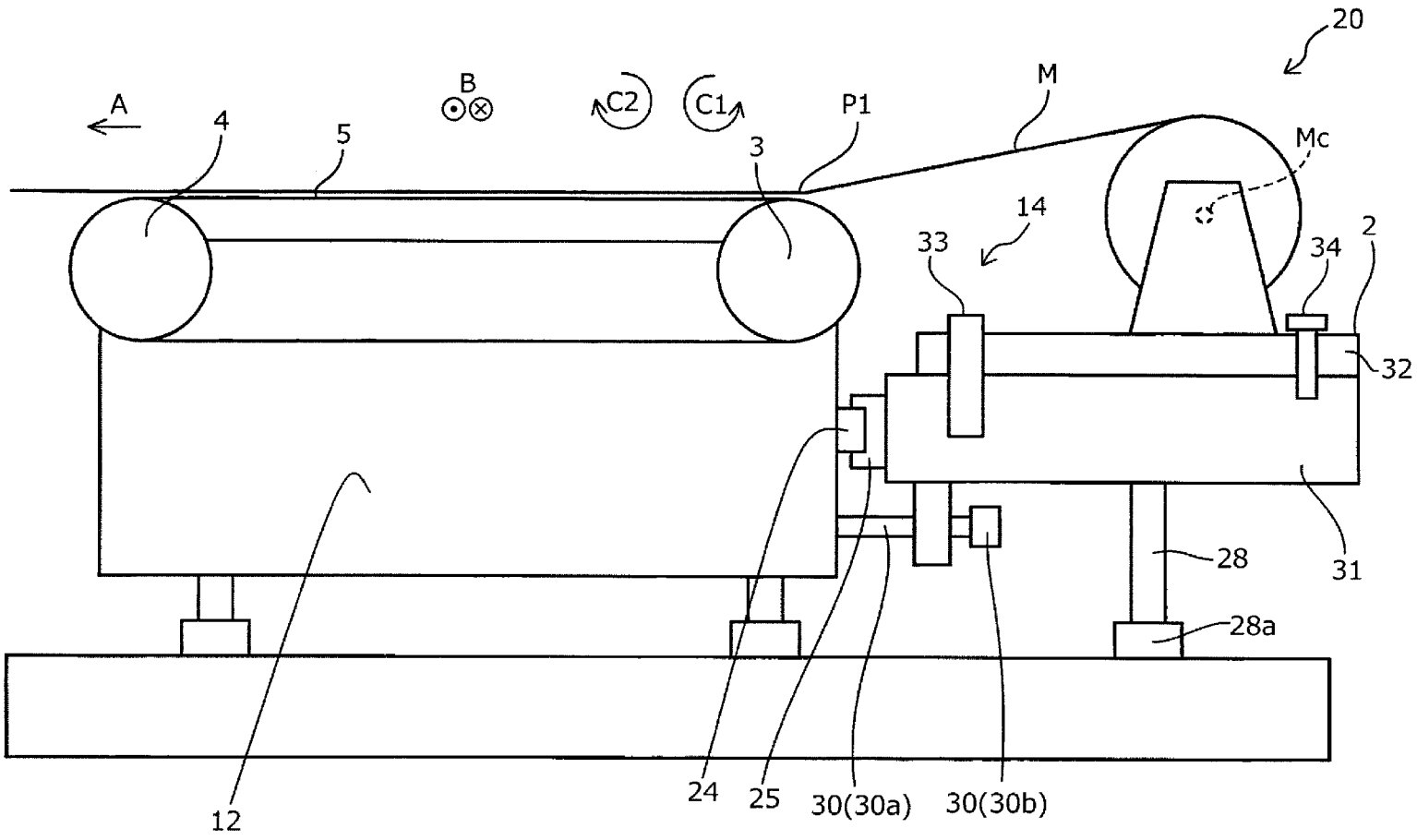
FIG. 12 is a schematic side view of the transport device in the printing apparatus according to Example 2 of the present disclosure.

Example 2 (FIG. 12)

The coupling portion 14 in the printing apparatus 1 of Example 1 has the configuration including the ball joint 26. However, the configuration of the coupling 14 is not limited to the configuration including the ball joint 26. Here, the printing apparatus 1 of Example 2, in which the configuration of the coupling portion 14 differs from the configuration of the coupling portion 14 in the printing apparatus 1 of Example 1, will be described below with reference to FIG. 12. FIG. 12 is a schematic side view of the transport device 20 in the printing apparatus 1 of this example, and is a diagram corresponding to FIG. 2 of the printing apparatus 1 of Example 1. Here, the printing apparatus 1 of this example has the same configuration as that of the printing apparatus 1 of Example 1 apart from the configuration of the transport device 20, and a description of common portions of the configuration, such as portions other than the transport device 20, is therefore omitted here. Note that the structural members common to those in Example 1 described above are denoted by the same reference numerals, and a detailed description thereof is omitted.

As illustrated in FIG. 12, the main body 12 of the transport device 20 of this example includes a sliding table 31. The sliding table 31 includes the sliding portion 25 that can slide in the width direction B with respect to the slide rail 24 provided on the main body 12. Therefore, the sliding table 31 is configured to be slidable, together with the sliding portion 25, in the width direction B with respect to the main body 12. Further, the sliding table 31 includes the height adjusting screws 28*a* and the horizontal positioning screws 30.

In addition, when viewed from the vertical direction, the feeding unit 2 of this example includes the rotating stage 32, an arrangement of which can be shifted in the rotational direction with respect to the sliding table 31, with a pin 33 that is a rotating shaft serving as the rotational fulcrum. Here, the pin 33 serves as the coupling portion 14 between the main body 12 and the feeding unit 2. Further, the feeding unit 2 of this example includes a positioning screw 34 that positions and then fixes the sliding table 31 and the rotating stage 32. At this time, the positioning screw 34 can be said to be the fixing member that fixes the posture of the feeding unit 2.

In this manner, also in the configuration in which the sliding table 31 is rotated with the pin 33 serving as the rotational fulcrum, the posture of the feeding unit 2 can be changed so as to incline the rotating shaft Mc of the medium M with respect to the width direction B. As a result, it is possible to adjust a difference between a feed distance L1 of the medium M from an end portion on a first side in the width direction B of the feeding unit 2 to the transport belt 5, and a feed distance L2 of the medium M from an end portion on a second side in the width direction B of the feeding unit 2 to the transport belt 5, that is, adjust the left-right difference in the feed distances. Transport defects of the medium M can thus be suppressed.

Figure 13:
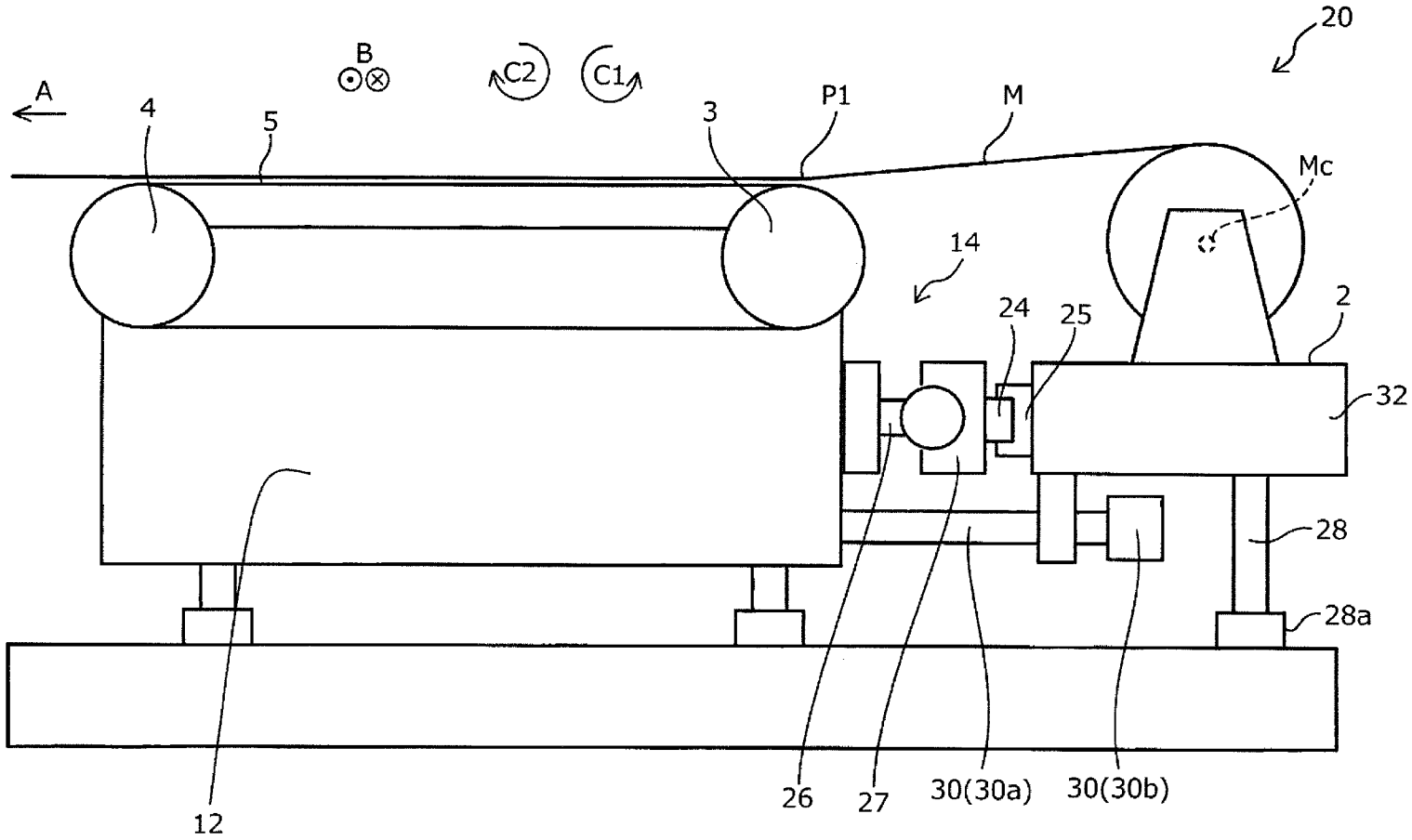
FIG. 13 is a schematic side view of the transport device in the printing apparatus according to Example 3 of the present disclosure.

Example 3 (FIG. 13)

The transport device 20 of the printing apparatus 1 of Example 1 and Example 2 has the configuration in which the coupling portion 14 is movable, together with the feeding unit 2, in the width direction B with respect to the main body 12. However, the coupling portion 14 is not limited to the configuration in which it is movable, together with the feeding unit 2, in the width direction B with respect to the main body 12. Here, the printing apparatus 1 of Example 3, in which the feeding unit 2 is movable in the width direction B with respect to the coupling portion 14, will be described below with reference to FIG. 13. FIG. 13 is a schematic side view of the transport device 20 in the printing apparatus 1 of this example, and is a diagram corresponding to FIG. 2 of the printing apparatus 1 of Example 1, and FIG. 12 of the printing apparatus 1 of Example 2. Here, the printing apparatus 1 of this example has the same configuration as that of the printing apparatus 1 of Example 1 and Example 2 apart from the configuration of the transport device 20, and a description of common portions of the configuration, such as portions other than the transport device 20, is therefore omitted here. Note that the structural members common to those in Example 1 and Example 2 described above are denoted by the same reference numerals, and a detailed description thereof is omitted.

The transport device 20 of this example includes the coupling portion 14 that couples the feeding unit 2 and the main body 12. The coupling portion 14 includes the ball joint 26 and the ball joint support portion 27 that rotatably supports the ball joint 26, and the slide rail 24 fixed to the ball joint support portion 27. At this time, the ball joint 26 is fixed to the main body 12. Specifically, the ball joint 26 is attached to a central portion of the main body 12 in the width direction B. Note that the "central portion" here is not limited to a central position in a strict sense, but also includes a position near the center.

Further, the feeding unit 2 of this example includes the rotating stage 32 and the sliding portion 25 that is fixed to the rotating stage 32 and is slidable in the width direction B with respect to the slide rail 24. The rotating stage 32 is configured to be slidable, together with the sliding portion 25, in the width direction B with respect to the main body 12. At this time, the members configuring the coupling portion 14 do not slide in the width direction B and remain in place, together with the main body 12. In other words, the members configuring the feeding unit 2 are configured to be slidable in the width direction B with respect to the members configuring the coupling portion 14.

With this type of configuration, the feeding unit 2 of this example is configured to be movable in the width direction B with respect to the coupling portion 14. Then, as a result of the transport device 20 of this example having this type of configuration, the medium M can be supported at an appropriate position on the transport belt 5 in the width direction B.

Note that the present disclosure is not limited to the above-described examples, and various modifications are possible within the scope of the disclosure as described in the appended claims. It goes without saying that these modifications also fall within the scope of the present disclosure.

What is claimed is:

1. A transport device comprising:

a feeding unit on which a roll-type medium is set, and that is configured to feed the medium by rotating the set medium;

an endless transport belt configured to feed the medium in a transport direction by supporting the medium fed out from the feeding unit and rotating;

a main body configured to hold the transport belt; and a coupling portion configured to couple the feeding unit and the main body, wherein the feeding unit is configured to change a posture thereof to incline a rotating shaft of the medium with respect to a width direction, that is a direction intersecting the transport direction, when viewed from a support direction in which the transport belt supports the medium, the feeding unit is configured to rotate around a rotational fulcrum to incline the rotating shaft with respect to the width direction when viewed from the support direction, and the feeding unit is configured to rotate with respect to the main body, with the coupling portion serving as the rotational fulcrum.

2. The transport device according to claim 1, wherein the feeding unit includes the rotational fulcrum in a central portion of the feeding unit in the width direction.

3. The transport device according to claim 1, wherein the coupling portion is configured to move, together with the feeding unit, with respect to the main body in the width direction.

4. The transport device according to claim 1, the feeding unit is configured to move in the width direction with respect to the coupling portion.

5. The transport device according to claim 1, wherein the coupling portion is disposed in a region between the rotating shaft and a first contact position, the first contact position being a position at which the medium set on the feeding unit first comes into contact with a member of the main body.

6. The transport device according to claim 1, wherein the feeding unit includes a fixing member configured to fix the posture of the feeding unit.

7. A printing apparatus comprising:

the transport device according to claim 1; and a printing unit configured to perform printing on the medium supported by the transport belt.

8. A method for adjusting a feeding unit in a transport device including the feeding unit on which a roll-type medium is set, and that is configured to feed the medium by rotating the set medium, an endless transport belt configured to feed the medium in a transport direction by supporting the medium fed out from the feeding unit and rotating, a main body configured to hold the transport belt, and a coupling portion configured to couple the feeding unit and the main body, the method for adjusting the feeding unit comprising:

adjusting a difference between a feed distance of the medium from an end portion on a first side in a width direction of the feeding unit to the transport belt, and a feed distance of the medium from an end portion on a second side in the width direction of the feeding unit to the transport belt, by changing a posture of the feeding unit to incline a rotating shaft of the medium with respect to the width direction, that is a direction intersecting the transport direction, when viewed from a support direction in which the transport belt supports the medium, wherein the feeding unit is configured to rotate around a rotational fulcrum to incline the rotating shaft with respect to the width direction when viewed from the support direction, and the feeding unit is configured to rotate with respect to the main body, with the coupling portion serving as the rotational fulcrum.

* * * * *